United States Patent [19]

Kavizky

[11] Patent Number: 4,918,951

[45] Date of Patent: Apr. 24, 1990

[54] LOCKING DEVICE PARTICULARLY USEFUL FOR LOCKING MOTORCYCLES, BICYCLES AND THE LIKE

[76] Inventor: Abraham Kavizky, 9 Ilanot Street, Gat Rimon 49920, Israel

[21] Appl. No.: 373,138

[22] Filed: Jun. 29, 1989

[51] Int. Cl.[5] ..... E05B 67/06

[52] U.S. Cl. ..... 70/53; 70/39

[58] Field of Search ..... 70/39, 53, 24, 25, 26

[56] References Cited

U.S. PATENT DOCUMENTS

| | | | |
|---|---|---|---|
| 552,340 | 12/1895 | Tyack | 70/53 |
| 1,021,456 | 3/1912 | Evans | 70/53 |
| 1,426,978 | 8/1922 | Gambino | 70/53 |
| 2,924,960 | 2/1960 | Palazzo | 70/39 |
| 4,085,600 | 4/1978 | El Bindasi | 70/59 |

FOREIGN PATENT DOCUMENTS

| | | | |
|---|---|---|---|
| 415439 | 10/1946 | Italy | 70/39 |

*Primary Examiner*—Robert L. Wolfe

*Attorney, Agent, or Firm*—Benjamin J. Barish

[57] ABSTRACT

A locking device particularly useful for locking a motorcycle, bicycle or other movable object to a fixed object, comprises a shackle including a pair of rigid, cylindrical bars of strong material pivotally mounted to each other at one end and terminating opposite to the pivotal mounting in a pair of free, inwardly-bent, straight end. The free inwardly-bent ends of the bars are a small fraction of the length of the remainder of the bars and are joined thereto by integrally formed angled junctures. The locking device further includes a locking mechanism enclosed within a housing formed with a pair of openings for receiving the free ends of the shackle bars thereby to lock them to the housing.

10 Claims, 1 Drawing Sheet

FIG 1
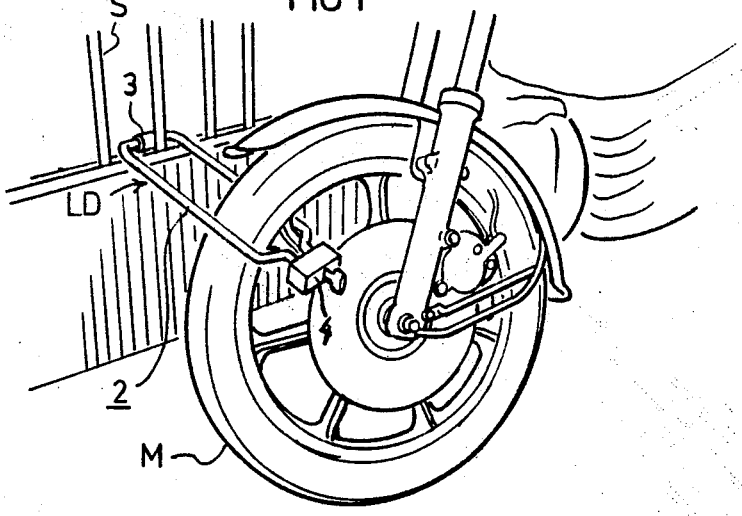
FIG 2
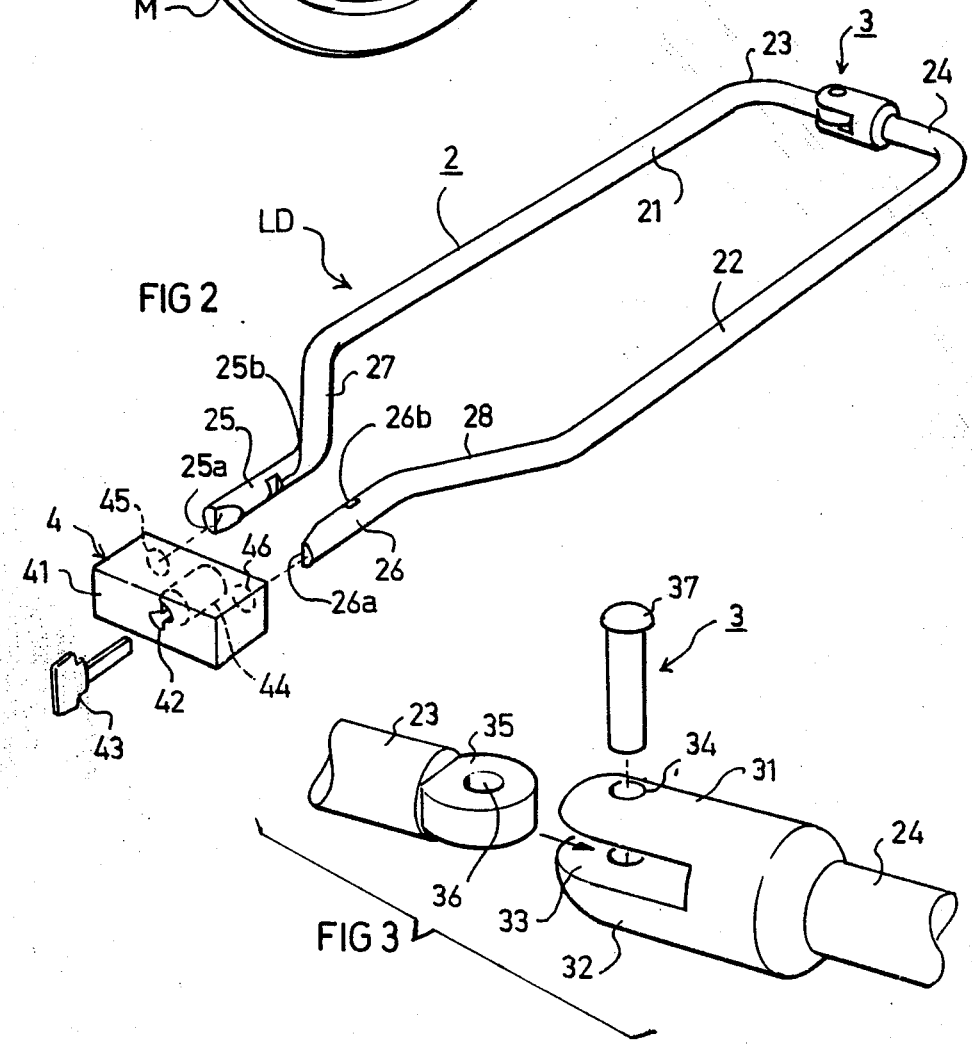
FIG 3

LOCKING DEVICE PARTICULARLY USEFUL FOR LOCKING MOTORCYCLES, BICYCLES AND THE LIKE

BACKGROUND OF THE INVENTION

The present invention relates to locking devices, and particularly to locking devices useful for locking a motorcycle, bicycle or other relatively movable object to a fixed object.

The present locking devices of this type usually include a shackle chain for enclosing a part of the movable object and a part of the fixed object, and a lock for locking the shackle chain, when in its enclosing position to thereby attach the movable object to the fixed object when the lock is in its locked condition, or for releasing the shackle chain to permit detachment of the movable object from the fixed object when the lock is in its released condition. Locks of this type are relatively inconvenient to use and to carry when not in use. Moreover, since a chain is as strong as its weakest link, these types of locking devices are relatively easy to break by cutting or by applying brute force.

Locking devices including rigid shackles of U-shaped configuration have also been used, in which the lock is applied to the open ends of the U-shaped shackle, but in such types of locking devices the legs of the shackle must be closely spaced to permit the use of relatively small locks, and therefore they are extremely limited as to the dimensions of the movable object (e.g., motorcycle wheel) to be enclosed by the shackle for fixing the motorcycle wheel to the fixed object.

OBJECTS AND SUMMARY OF THE PRESENT INVENTION

A main object of the present invention is to provide a locking device having advantages in the above respects.

The present invention, provides a locking device particularly useful for locking a motorcycle, bicycle or other object to be fixed with respect to a movable object, comprising a shackle for enclosing a part of the movable object and a part of the fixed object; and a lock for locking the shackle when in an enclosing position to attach the movable object to the fixed object when the lock is in its locked position, or for releasing the shackle to permit detachment of the movable object from the fixed object when the lock is in its released condition. According to the present invention the shackle comprises a pair of rigid bars of strong material disposed in a common plane, the pair of rigid bars being pivotally mounted to each other at one end so as to be pivotal in said common plane to an open or closed position, and terminating opposite to the pivotal mounting in a pair of free ends extending parallel to each other; and the locking device comprises a housing enclosing a locking mechanism and formed with a pair of openings for receiving the free ends of the shackle thereby to lock the movable object to the fixed object.

According to further features in the described preferred embodiment, the free ends of the rigid bars are bent inwardly towards each other such as to permit them to be inserted into relatively closely-spaced openings in the lock housing, while the remainders of the bars are relatively widely-spaced to permit them to enclose relatively large parts of the movable object and of the fixed object. Preferably, the free ends of the bars are a small fraction of the length of the remainders of the bars, and are joined thereto by integrally-formed junctures.

According to further features in the described preferred embodiment, the remainders of the bars are substantially parallel to each other in the locked condition of the shackle, and have inwardly-extending ends carrying the pivotal mounting. In the described preferred embodiment, the pivotal mounting comprises an apertured bifurcated end on one of the bars, an apertured ear on the other bar and received between the bifurcations, and a pivot pin passing through the apertures in the bifurcations and the ear.

According to further features in the described preferred embodiment, the free ends of the bars are formed with tapered tips to facilitate their insertion into the openings in the lock housing, and with notches on their inner confronting faces to be engaged by the locking mechanism within the lock housing for locking the bars to the lock housing. Preferably, the shackle bars are of cylindrical cross-section and are made of hardened steel.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates one form of locking device constructed in accordance with the present invention as applied to lock a motorcycle to a fixed object;

FIG. 2 is an exploded view illustrating the locking device of FIG. 1; and

FIG. 3 is a fragmentary view more particularly illustrating the construction of the pivotal mounting in the locking device of FIG. 2.

DESCRIPTION OF A PREFERRED EMBODIMENT

FIG. 1 illustrates a locking device, generally designated LD, constructed in accordance with the present invention and used for locking a motorcycle wheel M to a fixed stand S. Briefly, the locking device comprises a shackle, generally designated 2, having a pair of rigid bars of strong material, e.g., hardened steel, pivotally mounted to each other at one end, as shown by pivotal mounting 3, and terminating opposite to their pivotal mounting in a pair of free ends received within a lock 4. When lock 4 is thus removed from the shackle 2, the two legs of the shackle may be pivoted via pivotal mounting 3 to enclose the wheel M of the motorcycle and a part of the fixed stand S, and the lock may then be applied to lock the shackle in its enclosing position, thereby to prevent removal of the motorcycle from the stand.

The structure of locking device LD is more particularly illustrated in FIG. 1, and the structure of its pivotal mounting 3 is more particularly illustrated in FIG. 3.

With respect to FIG. 2, it will seen that the shackle 2 of locking device LD comprises a pair of rigid bars 21, 22 of strong material, preferably of cylindrical cross-section, disposed in a common plane. The two bars are straight for a major part of the lengths, and are inturned at one end 23, 24 for receiving pivotal mounting 3, to permit the bars to be pivoted in the common plane from an open position to a closed position for enclosing a part of the wheel M of the motorcycle together with a part of the fixed stand S. Lock 4 is applied to fix the two bars in their enclosing positions, and thereby prevents movement of the motorcycle with respect to the stand. Shackle bars 21, 22 are integrally formed with a pair of inwardly-bent free ends 25, 26 extending parallel to each other, and with angled junctures 27, 28 joining the free ends to the remainders of the shackle bars. The free ends 25, 26 of the shackle bars are formed with tapered tips 25*a*, 26*a* to facilitate their insertion into openings formed in lock 4, and with notches 25*b*, 26*b* on their inner confronting faces to be engaged by the locking mechanism within the lock housing for locking the shackle bars to the lock housing.

Pivotal mounting 3, as shown particularly in FIG. 3, is constituted of an apertured ear integrally formed in the inturned end 23 of shackle bar 21 pivotally received within apertured bifurcations formed in the inturned end 24 of shackle bar 22. Thus, inturned end 24 of shackle bar 22 is formed with a pair of bifurcations 31, 32 separated by a slot 33, the bifurcations being pierced by an aperture 34. The inturned end 23 of shackle bar 21 is integrally formed with an ear 35 of circular configuration and pierced by an aperture 36. Ear 35 is received within slot 33 between the two bifurcations 31, 32, and a pivot pin 37 is passed through the apertures 34 and 36 in the bifurcations and the ear, respectively.

Lock 4 may be any standard lock including a housing 41 formed with a keyhole 42 for receiving a key 43 inserted into the housing to operate a locking mechanism, generally designated 44, within the housing. Housing 41 is further formed with a pair of openings 45, 46 spaced so as to receive the inwardly-bent free ends 25, 26 of the shackle bars 21, 22.

As indicated earlier, the tapered tips 25*a*, 26*a* of the free ends 25, 26 of the shackle bars of the shackle bars facilitate their insertion into openings 45, 46 of the lock housing 41. The notches 25*b*, 26*b* formed at the free ends of the shackle bars are engaged by portions of the lock mechanism 44 within housing 41 when moved to locking position to prevent removal of the shackle bars, and are disengaged when the lock is in its released condition to permit removal of the shackle bars, and thereby to permit detachment of the lock from motorcycle wheel M and stand S.

The manner of using the locking device illustrated in the drawings will be apparent from the above description. Thus, in order to permit attachment of the locking device to a motorcycle wheel M and stand S, key 43 of the locking device is moved to actuate the locking mechanism 44 to release the ends 25, 26 of the shackle bars 21, 22. The shackle bars 21, 22 may be then pivoted as desired, via pivotal mounting 3, so as to enclose a part of the wheel M of the motorcycle with respect to any conveniently located fixed object, such as a bar of stand S. Lock housing 41 is then applied to the shackle bars 21, 22 by inserting the free ends 25, 26 of the shackle bars into openings 45, 46 in the lock housing. The lock thus secures the two free ends 25, 26 of the shackle bars 21, 22 while the shackle bars are in their enclosing condition, thereby preventing removal of the motorcycle from the fixed stand S.

When it is desired to remove the motorcycle, the proper key 43 is inserted into keyhole 42 of the lock housing 41 and is turned, to thereby cause locking mechanism 44 to release the free ends 25, 26 of the shackle bars 21, 22. The lock housing 41 may then be removed. This permits the shackle bars 21, 22 also to be removed, thereby enabling the motorcycle to be removed from the stand.

It will be seen that the pivotal mounting 3 of the two shackle bars 21, 22 enables the shackle bars to be moved so as to enclose any convenient portion of the motorcycle, e.g., its wheel M, to the fixed stand S. It will also be seen that the closely-spaced free ends 25, 26 of the shackle bars 21, 22 are only a small fraction of the length of the remainder of the shackle bars, thereby enabling a substantial portion of those bars to be used for enclosing the parts of the movable object (i.e., motorcycle wheel) and the fixed objects (e.g., stand S). Shackle bars 21, 22 may be made of extremely hard material, such as hardened and/or plated steel, to prevent easy severing by sawing or applying brute force. It will also be seen that the device may be not only conveniently applied when used, but may also be conveniently carried when not in use.

While the invention has been described with respect to locking a motorcycle to a fixed object, it will be appreciated that it could also be used for locking other devices, such as bicycles, to fixed objects, or for even locking a movable part, such as the spokes of the wheel, of a motorcycle or bicycle to a fixed part of the same motorcycle or bicycle, such as the frame.

Other variations, modifications and applications of the invention will be apparent.

What is claimed is:

1. A locking device particularly useful for locking a motorcycle, bicycle or other movable object to be fixed with respect to a fixed object, comprising a shackle for enclosing a part of the movable object and a part of the fixed object; and a lock for locking the shackle when in an enclosing position to attach the movable object to the fixed object when the lock is in its locked position, or for releasing the shackle to permit detachment of the movable object from the fixed object when the lock is in its released condition; characterized in that:

said shackle comprises a pair of rigid bars of strong material disposed in a common plane;

said pair of rigid bars being pivotally mounted to each other at one end so as to be pivotal in said common plane to an open position or a closed position and terminating opposite to the pivotal mounting in a pair of free ends extending parallel to each other;

said locking device comprising a housing enclosing a locking mechanism and formed with a pair of openings for receiving the free ends of the shackle thereby to lock the movable object to the fixed object;

said free ends of the rigid bars being bent inwardly towards each other such as to permit them to be inserted into relatively closely-spaced openings in the lock housing, while the remainders of the bars are relatively widely-spaced to permit them to enclose relatively large parts of the movable object and of the fixed object.

2. The locking device according to claim 1, wherein said inwardly-bent free ends of the bars are a small fraction of the length of the remainders of the bars, and are joined thereto by integrally-formed junctures.

3. The locking device according to claim 2, wherein said remainders of the bars are substantially straight and parallel to each other in the locked condition of the shackle, and have inwardly-extending ends carrying said pivotal mounting.

4. The locking device according to claim 3, wherein said pivotal mounting comprises an apertured bifurcated end on one of the bars, an apertured ear on the other bar and received between said bifurcations, and a pivot pin passing through the apertures in said bifurcated end and said ear.

5. The locking device according to claim 1, wherein said free ends of the bars are formed with tapered tips to facilitate their insertion into the openings in the lock housing, and with notches on their inner confronting faces to be engaged by the locking mechanism within the lock housing for locking the bars to the lock housing.

6. The locking device according to claim 1, wherein said shackle bars are of cylindrical cross-section.

7. The locking device according to claim 1, wherein said shackle bars are of steel.

8. A locking device particularly useful for locking a motorcycle, bicycle or other movable objects to a fixed object, comprising:

a shackle of cylindrical cross-section and of U-shaped configuration for enclosing a part of the movable object and a part of the fixed object;

said shackle comprising a pair of rigid, cylindrical bars of strong material disposed in a common plane;

said pair of rigid bars being pivotally mounted to each other at one end so as to be pivotal in said common plane to an open position or a closed position, and terminating opposite to the pivotal mounting in a pair of free, inwardly-bent straight ends; the inwardly-bent free ends of the bars being a small fraction of the length of the remainder of the bars and being joined thereto by integrally formed angled junctures;

said free ends of the rigid bars being bent inwardly towards each other such as to permit them to be inserted into relatively closely-spaced openings in the lock housing, while the remainders of the bars are relatively widely-spaced to permit them to enclose relatively large parts of the movable object and of the fixed object;

said shackle bars being substantially straight and parallel to each other for a major portion of their length when they are in their enclosing position, and having inwardly-extending ends carrying said pivotal mounting;

and a lock for locking the shackle bars, when in their enclosing position, said lock comprising a locking mechanism and a housing formed with a pair of openings for receiving the free ends of the shackle bars thereby to lock them to the housing when the shackle bars are in their enclosing position.

9. The locking device according to claim 8, wherein said pivotal mounting comprises an apertured bifurcated end on one of the bars, an apertured ear on the other bar and received between the bifurcations, and a pivot pin passing through the apertures in said bifurcations and said ear.

10. The locking device according to claim 8, wherein said free ends of the bars are formed with tapered tips to facilitate their insertion into the openings in the lock housing, and with notches on their inner confronting faces to be engaged by the locking mechanism within the lock housing for locking bars to the lock housing.

* * * * *